US008042461B2

(12) United States Patent
Skannerup

(10) Patent No.: US 8,042,461 B2
(45) Date of Patent: Oct. 25, 2011

(54) PARTIAL CONTROL SYSTEM FOR A PNEUMATIC WASTE COMPRESSOR

(75) Inventor: Kristian Skannerup, Ebeltoft (DK)

(73) Assignee: Mil-Tek Balers A/S, Ulfborg (DK)

( * ) Notice: Subject to any disclaimer, the term of this patent is extended or adjusted under 35 U.S.C. 154(b) by 44 days.

(21) Appl. No.: 12/527,953

(22) PCT Filed: Mar. 12, 2008

(86) PCT No.: PCT/DK2008/000098

§ 371 (c)(1),
(2), (4) Date: Oct. 20, 2009

(87) PCT Pub. No.: WO2008/110179

PCT Pub. Date: Sep. 18, 2008

(65) Prior Publication Data

US 2010/0095856 A1 Apr. 22, 2010

(30) Foreign Application Priority Data

Mar. 15, 2007 (DK) ..... 2007 00396

(51) Int. Cl.
*B30B 15/16* (2006.01)
*B30B 9/30* (2006.01)

(52) U.S. Cl. ..... 100/48; 100/215; 100/245; 100/266; 100/269.05; 100/269.14

(58) Field of Classification Search ..... 100/215, 100/226, 230, 240, 245, 266, 269.01, 269.05, 100/269.06, 269.14, 269.16, 269.18, 48, 52

See application file for complete search history.

(56) References Cited

U.S. PATENT DOCUMENTS 3,534,441 A * 10/1970 Walter ..... 425/501
5,109,763 A * 5/1992 Morris et al. ..... 100/48
5,174,199 A * 12/1992 King et al. ..... 100/48

FOREIGN PATENT DOCUMENTS

DE 3347392 A1 * 9/1984
GB 916311 1/1963
GB 2040794 9/1980

* cited by examiner

*Primary Examiner* — Jimmy T Nguyen
(74) *Attorney, Agent, or Firm* — Dennison, Schultz & MacDonald

(57) ABSTRACT

A pneumatic compressor for the compression of waste comprising a cylinder (1) with a piston (2), which via a piston rod (4) activates a compression plate (3), which is slidably mounted in a compression chamber (5) which has a top door (6) through which waste paper is thrown into the compressor, and a bottom door (7) through which a finished bale can be taken out, which compression takes place in a series of compression cycles, which each time is charged with a new portion of waste, until the waste offers a counter pressure corresponding to the pressure which the piston (2) can exert at a pressure of 8 bars. In 80-90% of the compression cycles necessary for the compression of a bale, the piston (2) reaches its bottom position in the cylinder, and each time the pressure reaches a pressure of 8 bars in the cylinder (1).

4 Claims, 7 Drawing Sheets

PARTIAL CONTROL SYSTEM FOR A PNEUMATIC WASTE COMPRESSOR

FIELD OF THE INVENTION

The present invention relates to a partial control system for a pneumatic waste compressor.

BACKGROUND OF THE INVENTION

In the known waste compressors the waste is compressed by means of compressed air. The compressed waste is subjected to a constant state of compression, and this pressure is maintained, even when the waste becomes exposed to further compression. In 80-90% of the compression cycles required for the compression of a bale, when the piston is in its bottom position, before the resistance of the compressed waste exerts a counter pressure corresponding to the pressure, which the piston can exert at an air pressure of 8 bars. When the piston is in its bottom position the compressor continues to work, until the pressure in the cylinder is 8 bars, at which the compressor stops. The pressure in the cylinder remains at 8 bars, until a new portion o waste is to be compressed. When a filling door opens, a fast air-escape valve opens, which causes the compression cylinder to be emptied of air, and the piston—which is spring-loaded—moves upwards to its top position, whereby a pressing plate coupled to the piston also moves upwards and thereby makes room for a new portion of waste on top of the already compressed material. Consequently, the known waste compressors are very energy consuming.

It is a purpose of the invention to describe a partial control system by means of which the consumption of energy can be considerably reduced.

This is achieved by the control system described herein. This arrangement stops the air supply to the compressor, when the piston is in its bottom position.

The compressor according to the invention operates from 1 to a maximum of 8 bars in the cycles, where the bottom position of the piston is reached, before the quantity of waste is sufficiently compressed to be able to exert a counter force corresponding to the compression power of the cylinder.

The noise level will be reduced, because it is proportional to the air pressure and the volume of air.

Because the air consumption is lower, it is possible that the compressor can work faster, and it is possible to employ a compressor with a lower capacity. This also means lower maintenance costs and a longer life of the compressor.

BRIEF DESCRIPTION OF THE SEVERAL VIEWS OF THE DRAWINGS

The invention is explained in detail below with reference to the drawing, in which.

DETAILED DESCRIPTION OF THE INVENTION

Figure 1:
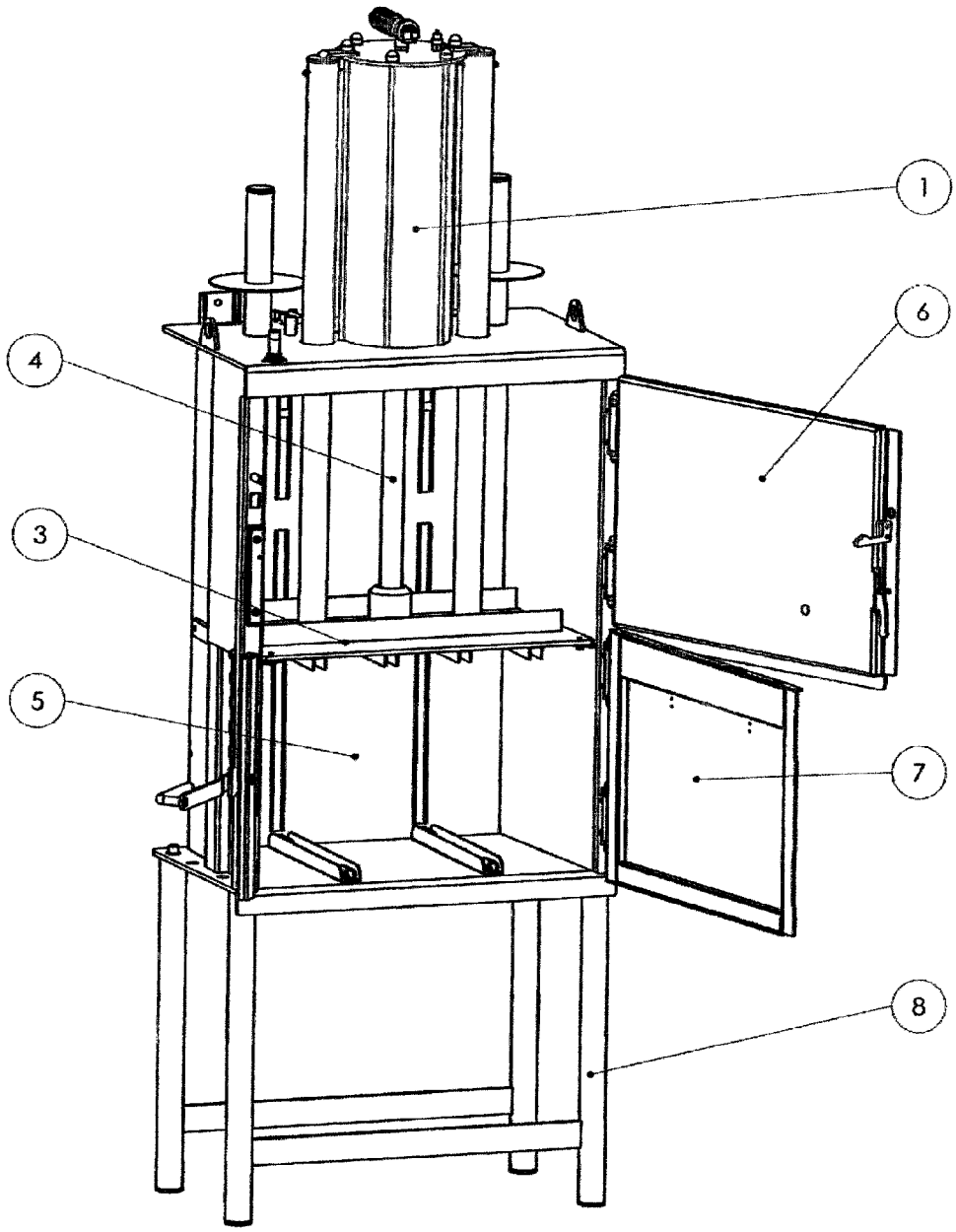
FIG. 1 is a perspective front view of a waste compressor with open doors.
Figure 2:
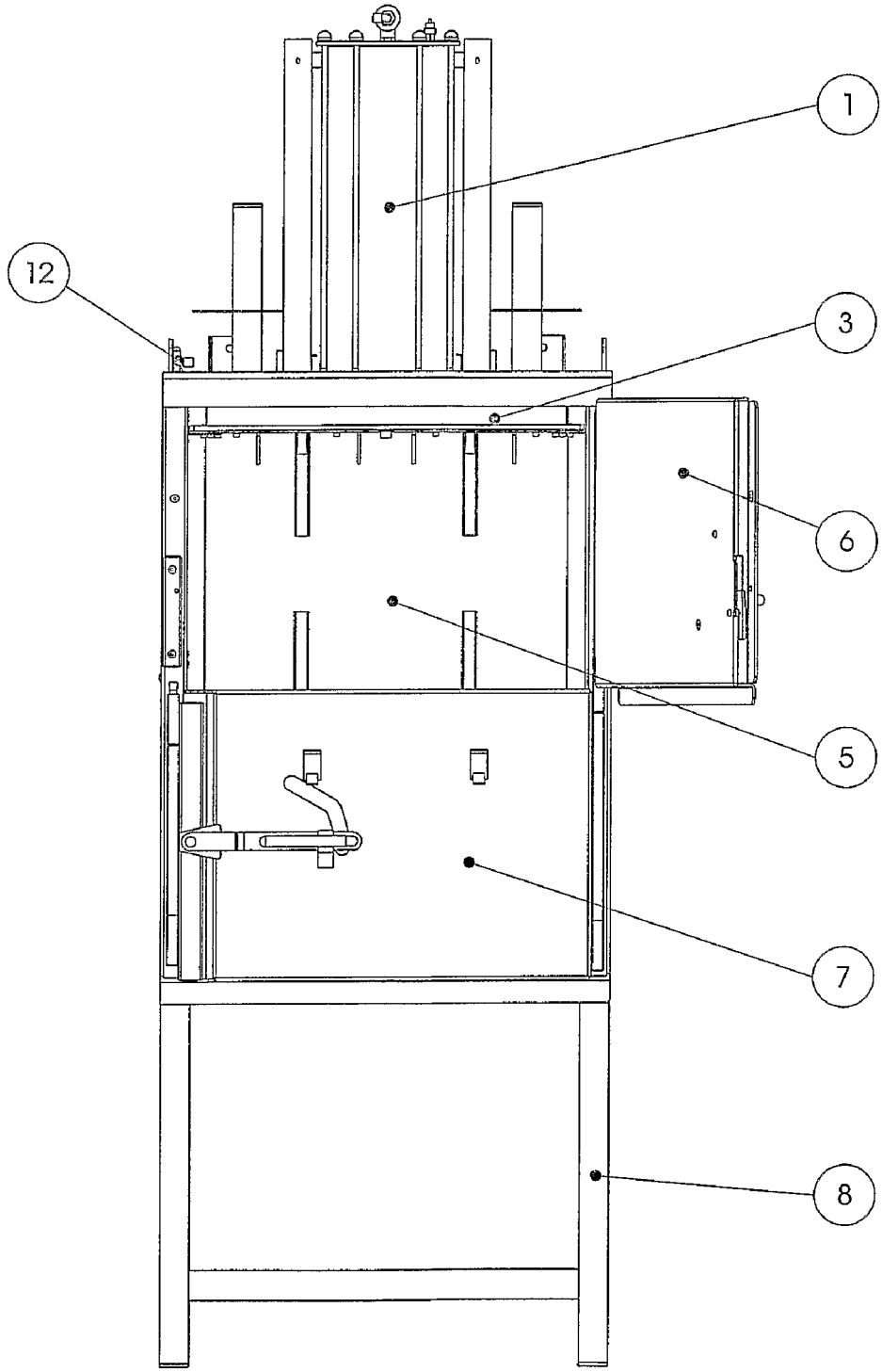
FIG. 2 is a front view of a waste compressor with the bottom door closed.
Figure 3:
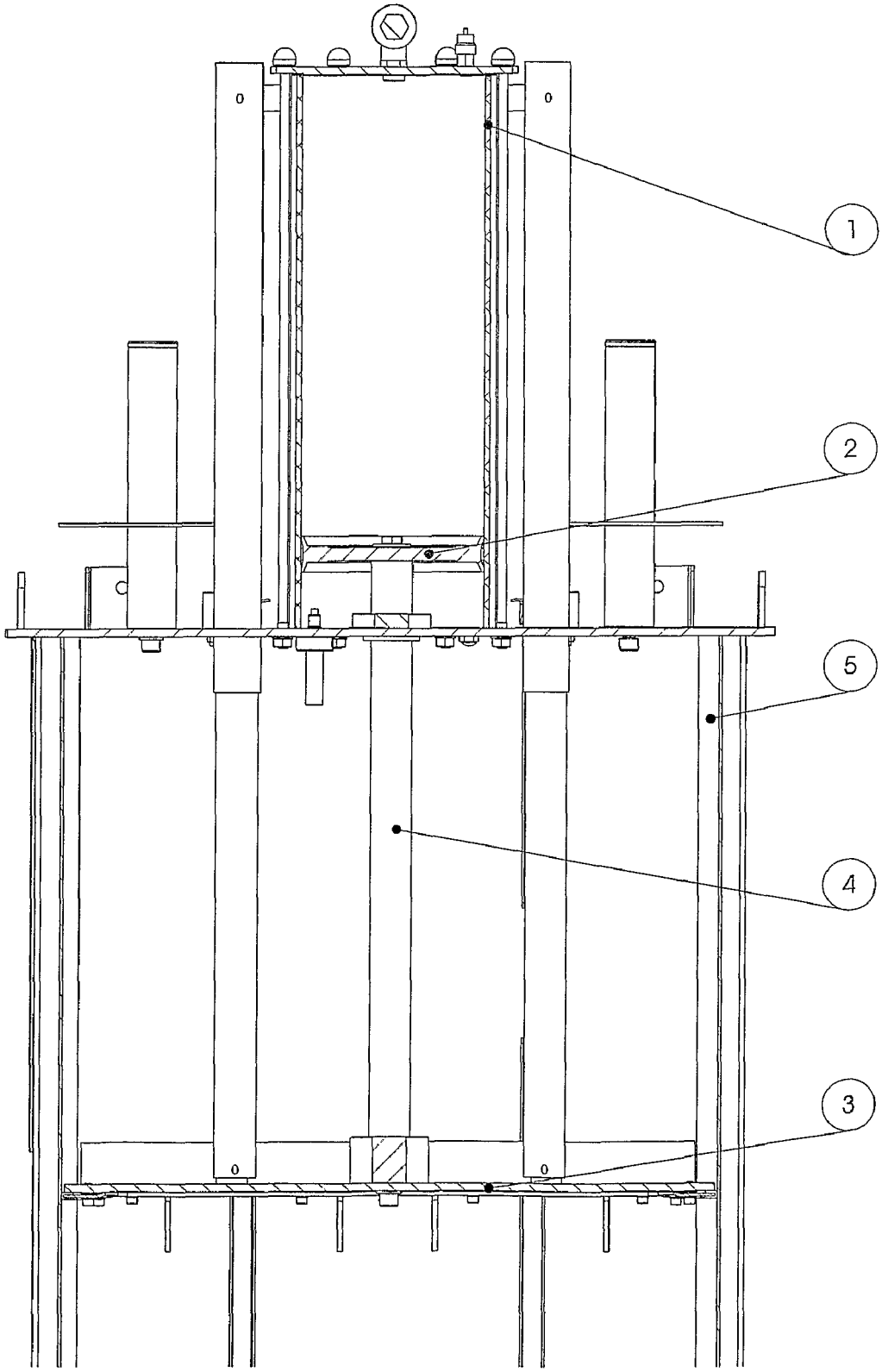
FIG. 3 is a sectional view of the upper part of a waste compressor.

FIGS. 1 and 2 show a pneumatic waste compressor consisting of a compressor cylinder 1 with a compressor piston 2, FIG. 3, which can be activated in the direction from the top of the cylinder to the bottom by compressed air and in the opposite direction by springs. The compression 2 is connected to a compression plate 3 by means of a piston rod 4. The compression plate 3 is slidably mounted in a compression chamber 5 arranged under the compression cylinder 1, into which chamber can be filled material, which is to be compressed, for example paper waste, through an upper door 6. Already compressed waste can be taken out through another door 7, which is located below the door 6. The waste compressor is mounted on legs 8.

Figure 4:
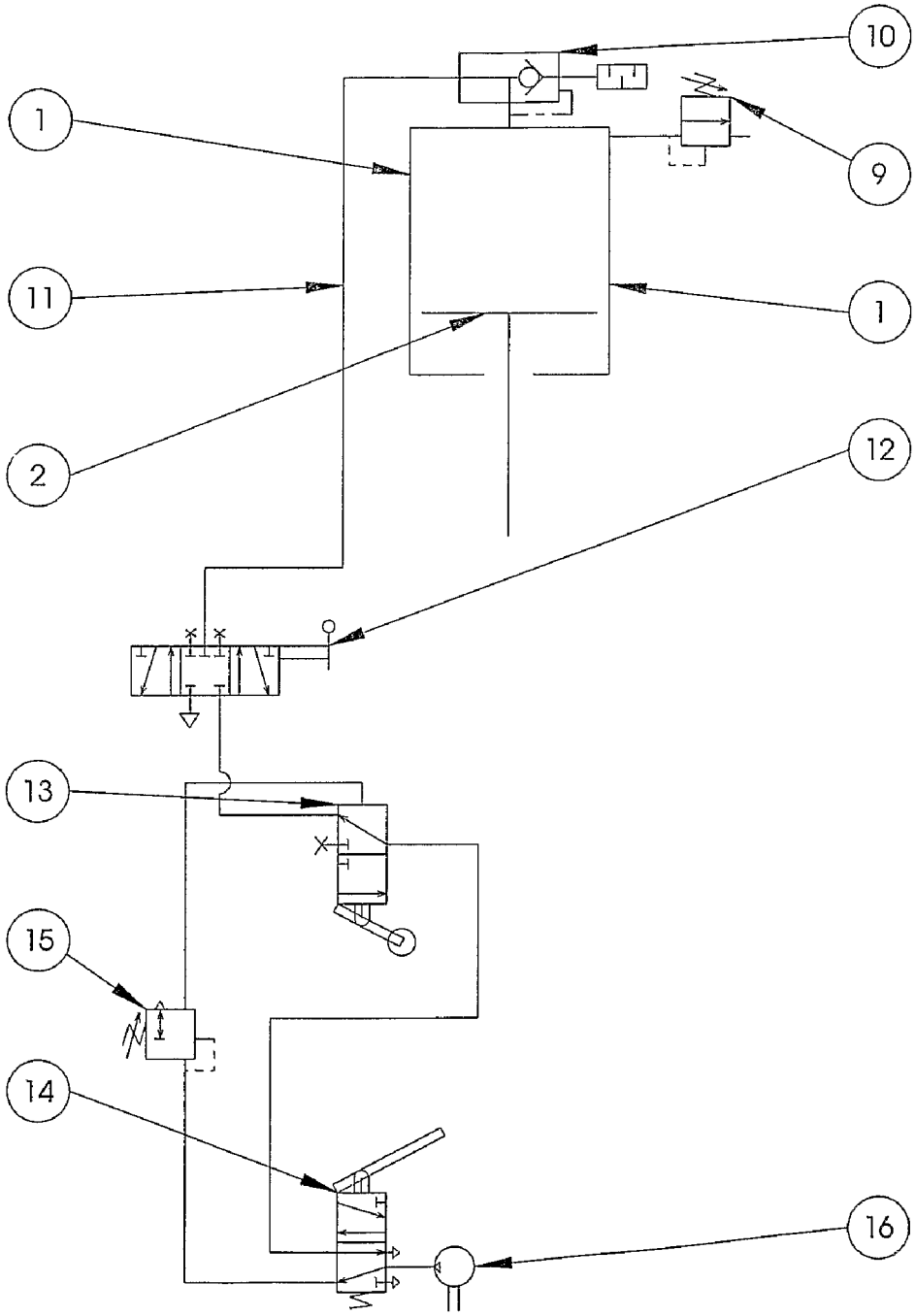
FIG. 4 is a schematic view of a cylinder for a waste compressor with a known control system.

As shown in FIG. 4 the compression cylinder 1 is connected at the top to a safety valve 9 and to a quick air-escape valve 10 which by a wire 11 is coupled to a manual control valve 12, which can be set at a frontal position, in which the piston 2 is moved down, a shown second, a central position, in which the piston 2 is locked, and through a rear position, to which the piston returns. On the admission side the control valve 12 is coupled to two valves 13 and 14, which are coupled to a hinge on the door 6. The valves open when the door 6 is closed, and close when the door 6 is opened. The two valves 13 and 14 are coupled together by a wire with a pressure governor 15. The valve 14 is connected to a compressor 16.

The waste compressor is operated and functions in the following way.

a. the door 6 opens, and waste to be compressed is placed in the compression chamber 5,
b. the valve 12 is set at its front position,
c. the door 6 is closed,
d. when the door 6 is closed, the valves 13 and 14 are activated,
e. the piston 2 compresses the material by putting pressure on the plate 3,
f. when the handle on the door 6 is opened, the valves 13 and 14 close for the air to the cylinder 1, which thereby returns to its top position by means of springs,
g. a new portion of waste is filled into the compression chamber 5, and the procedure from function c. is repeated until the compressor is filled up,
h. from this point the valve 12 is put in its central position in order to lock the compression plate in the position in which the waste is under pressure,
i. both doors 6 and 7 are opened, and the bale is tied up under pressure,
j. the valve 12 is set at its rearward position, which causes the compression plate 3 to return to its top position,
k. the waste bale is taken out, and
l. the procedure is repeated from item a.

The compressor is typically used in the way that the operator opens the door 6 and throws the waste into the compressor, after which he closes the door and leaves. The compressor is now left to build up a pressure in the cylinder 1 to 8 bars. When more waste arrives, the door 6 is opened, the air in the cylinder 1 is let out through the quick air-escape valve 10, and the compressor plate 3 will return to its top position, and the new waste is filled into the compressor, and so on and so forth.

This causes a heavy energy consumption, as the piston reaches its bottom position in 80-90% of the times, before the resistance from the compression is higher than the pressure which the piston 2 exerts at 8 bars.

According to the invention the control system of the waste compressor is incorporated with a partial control system comprising a non-return valve 17, which closes for compressed air to the cylinder 1, and a closing valve 18 whose admission side is coupled to the wire 11 in front of the non-return valve 17 by means of a wire 19, and whose discharge side is coupled to the wire 11 after the non-return valve 17 at the wire 20. There are means to activate the closing valve 18 to close, when the piston 2 is in its lowest bottom position in the cylinder 2, whereby the air supply to the compressor stops, and to open it again, when the piston 2 is raised when new waste is to be filled into the compressor.

Hereby the pressure in the cylinder 1 will at most reach 1-max. 8 bars in the preparatory compression cycles, until the quantity of waste is large enough to build up a counter pressure of 8 bars and until the compaction is finished.

Figure 5:
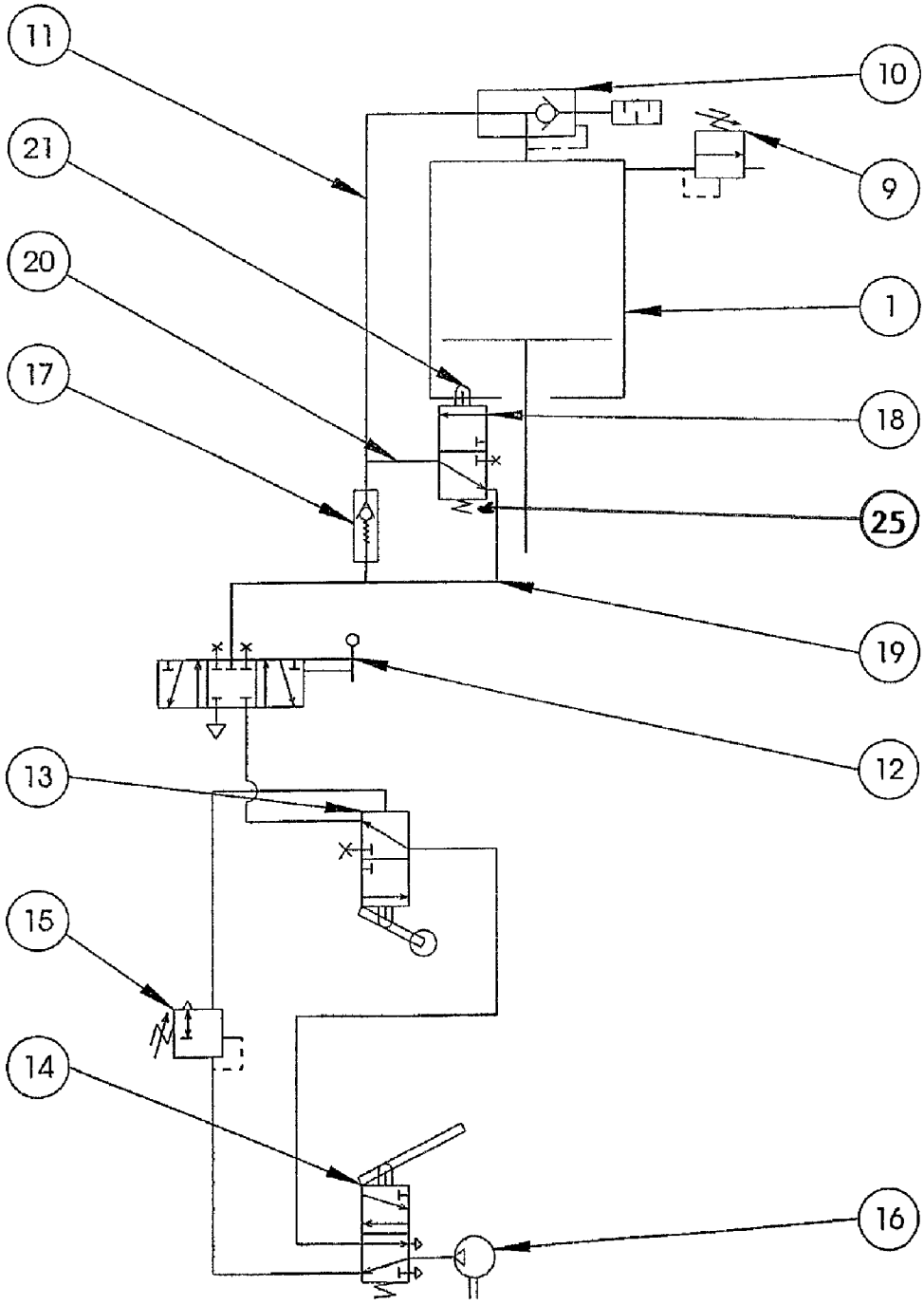
FIG. 5 is a schematic view of a cylinder for a waste compressor with a known control system and with a partial control system according to the invention.

As shown in FIG. 5 the closing valve 18 may be embodied with a butt knob 21 and a spring return 25 and mounted under the bottom of the cylinder 1, so that the butt knob 21 extends a short distance into the cylinder and is activated by the piston 2, when the latter is in its bottom position, by which the valve 18 closes.

Figure 6:
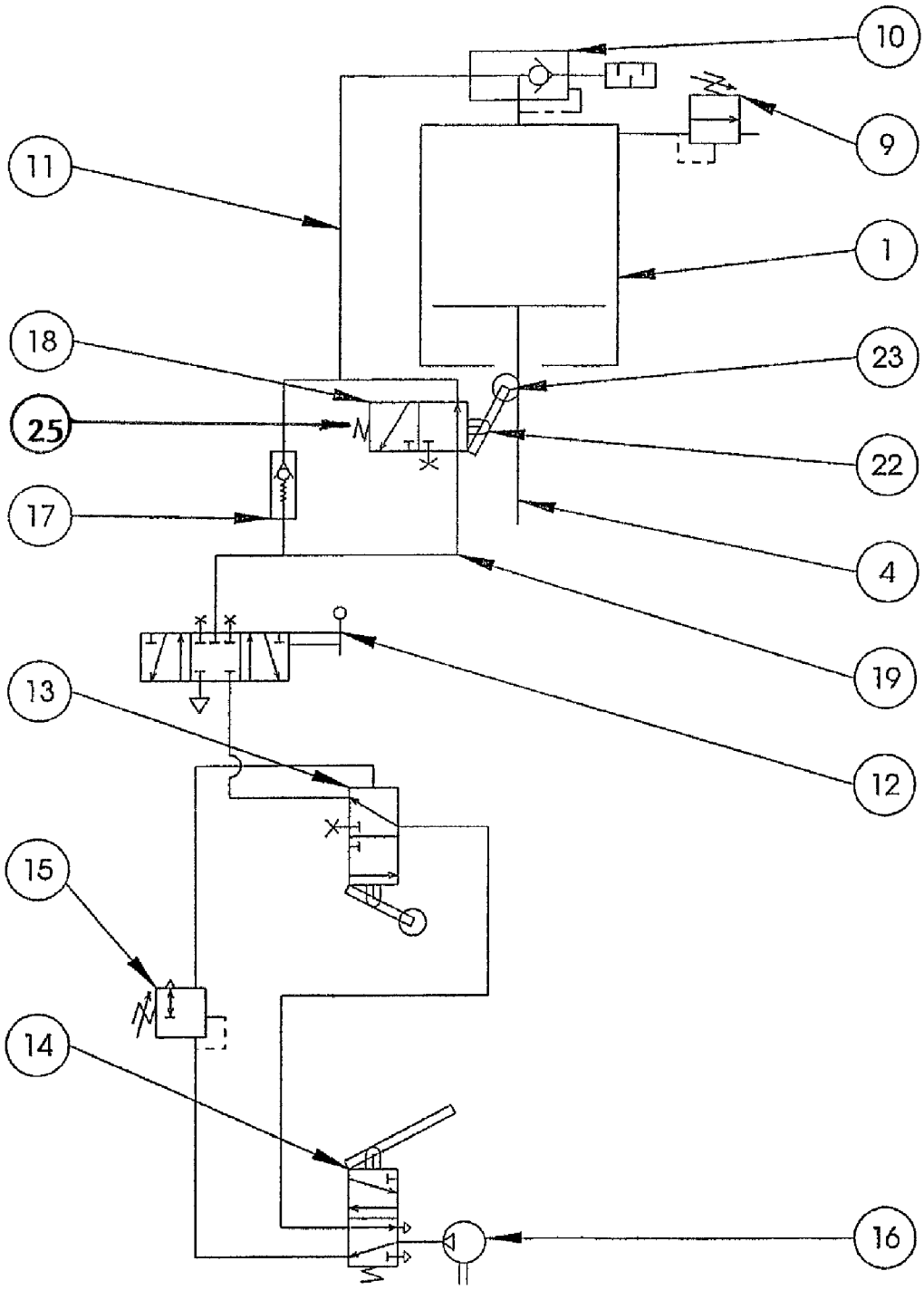
FIG. 6 is an illustration corresponding to the one shown in FIG. 5 in which the closing valve in the partial control system has another embodiment and location.

As shown in FIG. 6 the closing valve 18 may be mounted outside the cylinder 1 and embodied with a rocker arm 22 with a roller 23 which rests against the piston rod 4, which can have a groove, which can accommodate the roller 23, when the piston 2 is in its lowest position.

Figure 7:
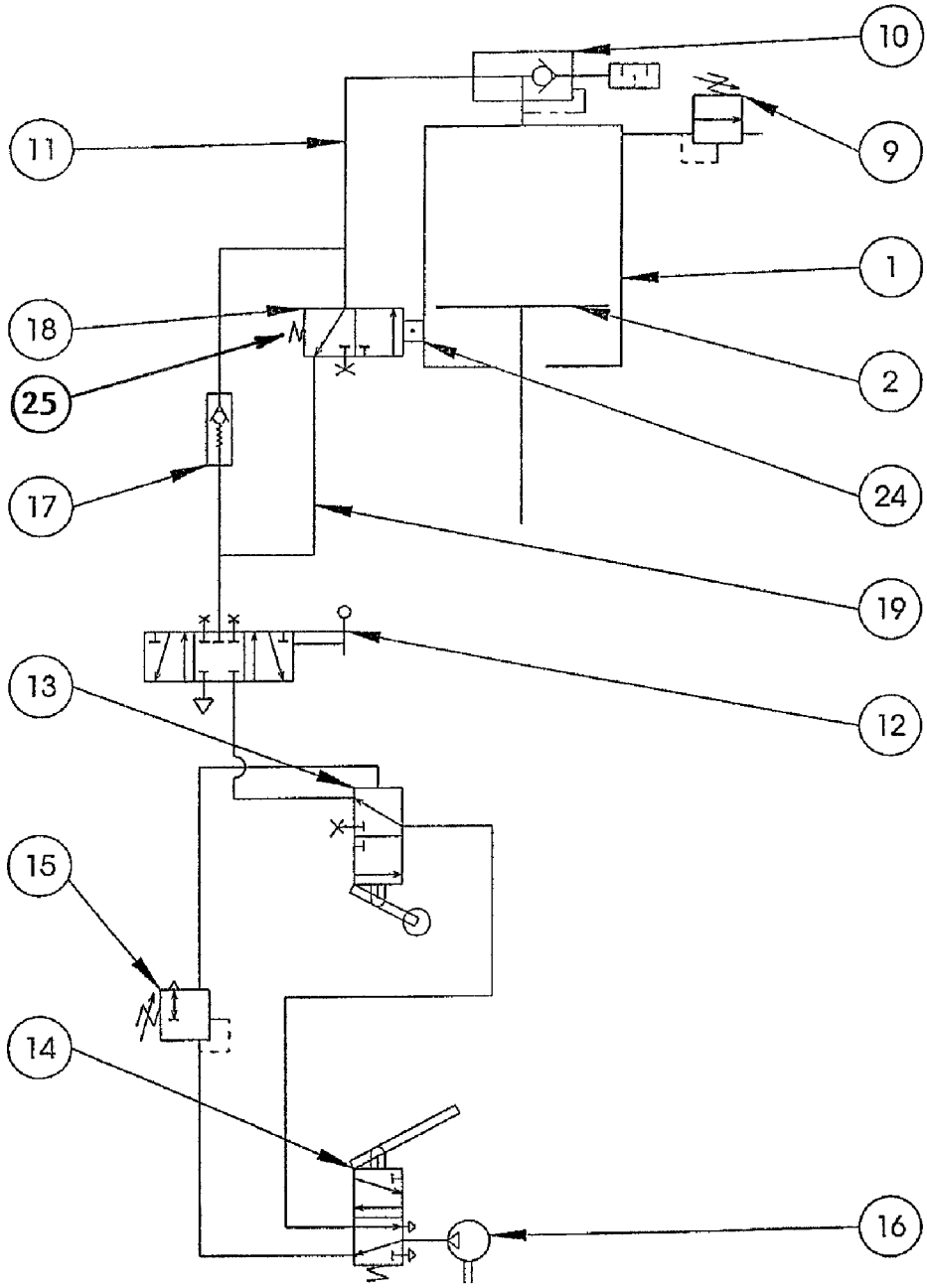
FIG. 7 is an illustration corresponding to the one shown in FIG. 5, in which the closing valve in the partial control system is of a third embodiment and location.

As shown in FIG. 7 the valve 18 may at one end be embodied with a magnet 24 and be mounted at the bottom outside the cylinder with the magnet 24 facing the cylinder. The piston is magnetic, and the magnet 24 will thus be pulled by the piston, when the latter is in its bottom position, which will cause the valve to close.

The invention claimed is:

1. A partial control system for a pneumatic waste compressor consisting of a compression cylinder with a compression piston connected to a compression plate by means of a piston rod, wherein said compression plate is slidably mounted in a compression chamber under the compressor cylinder, wherein material for compression is deposited through a first door of the compression chamber, wherein compressed waste is removed through a second door below the first door, wherein the compression cylinder is connected at the top to a fast air-escape valve, wherein said fast air-escape valve is coupled by a wire to a manually operated control valve, wherein said manually operated control valve is set to a front position (piston down), a central position (piston locked), and a rear position (piston return), wherein the control valve on the inlet side is coupled to two valves, wherein said two valves open for admission of compressed air from a compressor when the door is closed, and remain closed when the door is open, wherein the partial control system comprises a non-return valve, which is inserted in the wire and closes for admission of compressed air to the cylinder, and of a closing valve whose admission side is coupled to the wire in front of the non-return valve by a wire and whose discharge side is coupled to the wire after the non-return valve by a wire, and that there are means to activate the valve for closure, when the piston is in its lowest bottom position in the cylinder, whereby the supply of air to the compressor stops, and to open it again, when the piston is raised from its bottom position, when new waste is to be filled into the compressor.

2. A partial control system according to claim 1, wherein the closing valve is embodied with a butt knob and a spring return and is mounted under the bottom of the cylinder, so that the butt knob extends a short distance into the cylinder and is activated by the piston, when the latter is in its bottom position, by which the valve closes.

3. A partial control system according to claim 1, wherein the closing valve is mounted outside the cylinder and is embodied with a spring loaded rocker arm with a roller, wherein said roller rests against the piston rod, wherein the piston rod comprises a groove shaped and placed so that the roller is in mesh with groove when the piston is in its lowest position, whereby the valve closes.

4. A partial control system according to claim 1, wherein the valve is a spring return and at one end embodied with a magnet and is mounted at the bottom outside the cylinder with the magnet turned towards the cylinder, and that the piston is magnetic, whereby the magnet is pulled by the piston, when the latter is in its lowest position, whereby the valve closes.

* * * * *